United States Patent [19]

Kremer et al.

[11] 4,291,730

[45] Sep. 29, 1981

[54] DOUBLE-LIFT OPEN-SHED JACQUARD MACHINE

[75] Inventors: Hubert Kremer, Grefrath; Heinz Königs; Otto Gutmann, both of Krefeld, all of Fed. Rep. of Germany

[73] Assignee: Maschinenfabrik Carl Sangs Aktiengesellschaft, Krefeld, Fed. Rep. of Germany

[21] Appl. No.: 88,382

[22] Filed: Oct. 26, 1979

[30] Foreign Application Priority Data

Oct. 27, 1978 [DE] Fed. Rep. of Germany ..... 2846793

[51] Int. Cl.[3] ..... D03C 3/06

[52] U.S. Cl. ..... 139/65

[58] Field of Search ..... 139/59, 60, 61, 62, 139/63, 64, 65

[56] References Cited

U.S. PATENT DOCUMENTS 4,022,251 5/1977 Bucher ..... 139/65
4,023,598 5/1977 Bucher ..... 139/59
4,116,242 9/1978 Bucher ..... 139/65
4,867,363 1/1978 Keim ..... 139/59

*Primary Examiner*—Henry Jaudon
*Attorney, Agent, or Firm*—Martin A. Farber

[57] ABSTRACT

A double-lift open-shed jacquard machine with two lifting bars which are movable in opposite directions to each other and which pass each other, and with lifters controllable by main needles, the latter being arranged transverse to the knives of the lifting bars, which lifters have two main projections associated with the movable knives and one holding-up projection associated with a fixed upper-shed knife. The movable knives are made of a carrier part and hook plates fastened thereto with control hooks, the latter being bent off in the direction towards the main projections of the lifters and being arranged spaced apart from each other. The shaping of the hook plates and their control hooks permits in the control direction of the main needles a passage of the lifters up into a plane lying between the control hooks of a knife, and the shank of the lifters has a flat rectangular cross-section, whose greater bending moment lies in the control direction of the main needles.

12 Claims, 11 Drawing Figures

DOUBLE-LIFT OPEN-SHED JACQUARD MACHINE

The present invention relates to a double-lift open-shed Jacquard machine having two griff boxes which are movable in opposite directions to each other and pass each other, and having lifters controllable by main needles arranged transverse to the knives of the griff boxes, which lifters have two main noses associated with the movable knives and one holding-up nose associated with a fixed upper-shed knife.

Double-lift open-shed Jacquard machines having lifters developed with two legs are known. These lifters are provided with a main nose at the upper end of each leg and furthermore a holding-up nose on one leg. The main noses are associated with the crossing knives of the two griff boxes. These known lifters with the two long spring legs enter into undesired vibrations at high speeds of revolution so that the lifters which have been moved downward into the lower shed by one knife can come into engagement at their free unattached main nose with a knife of the ascending griff box. Errors in weave result therefrom. Furthermore, it may happen that when weaving thicker yarns and with a plurality of pattern repeats, in which connection a strong pulling back of the harness is necessary, the long resilient legs of the lifters will be bent so that lifters which are seated by their holding-up nose on a holding-up knife are no longer grasped on their main noses. In this way also defects in weaving result.

The use of two-leg lifters in double-lift open-shed Jacquard machines has furthermore also the disadvantage that the lifters must be pressed down with the main needles until the two griff boxes cross so that a lifter which is to be lowered into the lower shed is not grasped by an ascending knife. The pressing time of the lifters required for this results in unfavorable movement conditions on the reading-in mechanism by which the main needles are moved in accordance with the pattern. Since the lifters are simultaneously pushed under pressure within the offsets of the main needles until the crossing of the griff knives, increased wear of the lifters and the main needles also results.

In West German Unexamined Application for Patent OS No. 2 533 216 there is disclosed a Jacquard machine which partly overcomes these disadvantages, it operating with a single-bar lifter which cannot bend even upon strong pull of the harness. This known lifter is however turned around its longitudinal axis since its two main noses are arranged at an angle of about 90° from each other so that a lifted main nose sets itself transverse to the longitudinal direction of the knife while the other main nose, due to the swinging of the lifter around its longitudinal axis, is swung laterally into a position extending parallel to the knives and therefore can no longer be grasped.

In this known Jacquard machine, the lifter can also, in the case of very high speeds of revolution, enter into undesired vibrations which lead to reading errors and thus to defects in weave. One particularly disadvantage, however, is that the continuous sliding of the main noses on the knives causes a considerable amount of wear, and furthermore the main noses must have a cylindrical shape in order to cause as little frictional resistance as possible upon the turning movement. These disadvantages are not eliminated either by the improved embodiment in accordance with West German Unexamined Application for Patent OS No. 2 455 035 in which the lifters are guided in notches or slots of the knives.

Finally, from West German Pat. No. 2 533 216 there is known a double-lift open-shed Jacquard machine which is directed at avoiding the disadvantages inherent in the two-leg lifters without having to tolerate the difficulties which are produced with the embodiment of the teaching in accordance with West German Unexamined Application for Patent OS No. 2 316 649. For this purpose it is proposed that the knives of the crossing griff boxes be arranged parallel to the main needles and that the lifters be thus moved in longitudinal direction of the knives in order to bring their main noses into engagement with driver elements, spaced apart from each other, on the knives. Aside from the fact that driver elements spaced apart from each other in longitudinal direction of the knives for the reception of the main noses of the lifters also already belong to the prior art from West German Unexamined Application for Patent OS No. 2 455 035, the arrangement of the knives parallel to the main needles has the disadvantage as compared with the traditional arrangement of the knives transverse to the direction of movement of the main needles that a larger number of knives is required for Jacquard machines of the same type. Already with a standard type 1344 with 32 lifters behind one another and 42 alongside of each other, 43 knives are required as compared with the traditional arrangement with 33. In the case of the larger type 2688 with 32 lifters behind one another and 84 alongside of each other the number of knives is suddenly increased from 33 to 85. As compared with this, in the traditional arrangement of the knives transverse to the direction of movement of the main needles the number of knives remains constant while their length must be increased corresponding to the increasing width of the bundle of lifters. The increase in output obtained with an arrangement of knives parallel to the main needles must therefore be obtained at the cost of an increased technical expenditure which also results in a considerable increase in cost.

Proceeding herefrom, the object of the present invention is to create a double-lift open-shed Jacquard machine with crossing griff boxes and with knives extending in traditional manner transverse to the main needles, in which the control movements of the main needles and of the lifters are reduced in order to obtain an increase in output by a favorable leasing-in movement.

This object is achieved in the manner that the knives consist of a carrier part and two hook plates fastened thereto which have control hooks bent off in the direction towards the main noses of the lifters and arranged spaced apart from each other, that the shaping of the hook plates and their hooks permits in the control direction of the main needles the passage of the lifters up into a plane lying between the control hooks of a knife, and that the shank of the lifters has per se known manner a flat rectangular cross section the greater moment of flexure of which lies in the control direction of the main needles.

In a double-lift open-shed Jacquard machine developed in accordance with the invention the individual lifters are moved perpendicular to the longitudinal axis of the knives. Since at the same time a lifter which is not flexible in the control direction of the main needles, i.e. is rigid, is employed, their main noses and in particular also the knives must be so developed that they can engage one beneath the other when the lifter is to change its shed position and can slide past each other when the lifter is to remain in its basic position which corresponds to the lower-shed position. For this, the shaping of the hook plates which lie in front in the control direction and of their hooks is so selected that the main noses of the associated lifters and/or the upper end of the lifters can be swung through recesses into a plane which extends between the control hooks of a knife and is therefore parallel to the longitudinal direction of the knife. In this way, while retaining the traditional arrangement of the knives transverse to the longitudinal direction of the main needles the advantage is obtained of developing the lifters with flexural stiffness in the control direction, so that they can no longer enter into vibration even at high speeds of rotation.

For the shaping of the hook plates and their control hooks on the one hand and of the main noses of the lifters on the other hand various possibilities exist. Thus the control hooks and/or the main noses can be beveled so that their overlap increases upon the driving of a lifter. The control hooks and the main noses preferably extend parallel to the longitudinal direction of the knives. Since the remaining distance between the control hooks of adjacent knives is very small, notches are provided also in the hook plates which are in the rear in the direction of control, the shanks of the lifters lying within said notches.

It is also possible to arrange the control hooks of the two hook plates of the knife and the main noses of the lifters either at different heights or at the same height. For this, various illustrative embodiments will be described below with reference to the accompanying drawings in which.

Figure 1:
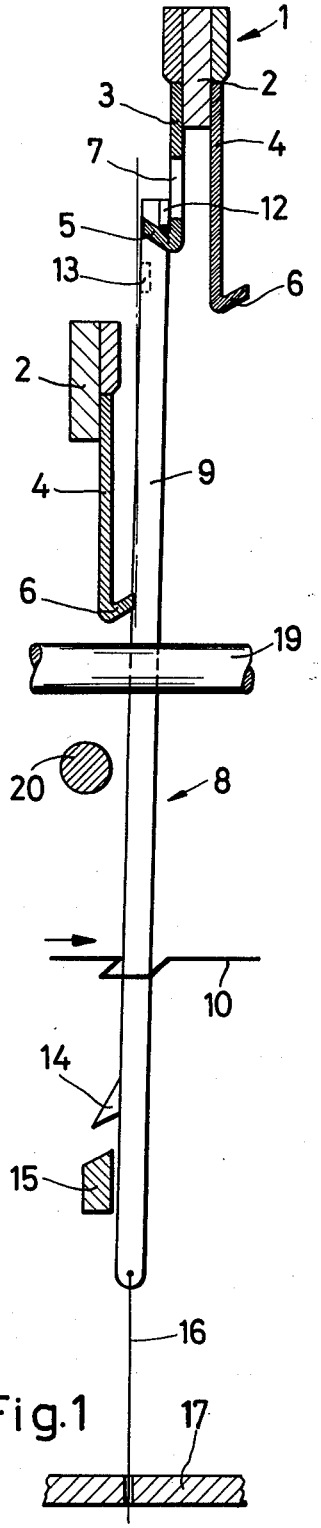
FIGS. 1 and 2 show a first embodiment in side view and in front view.
Figure 2:
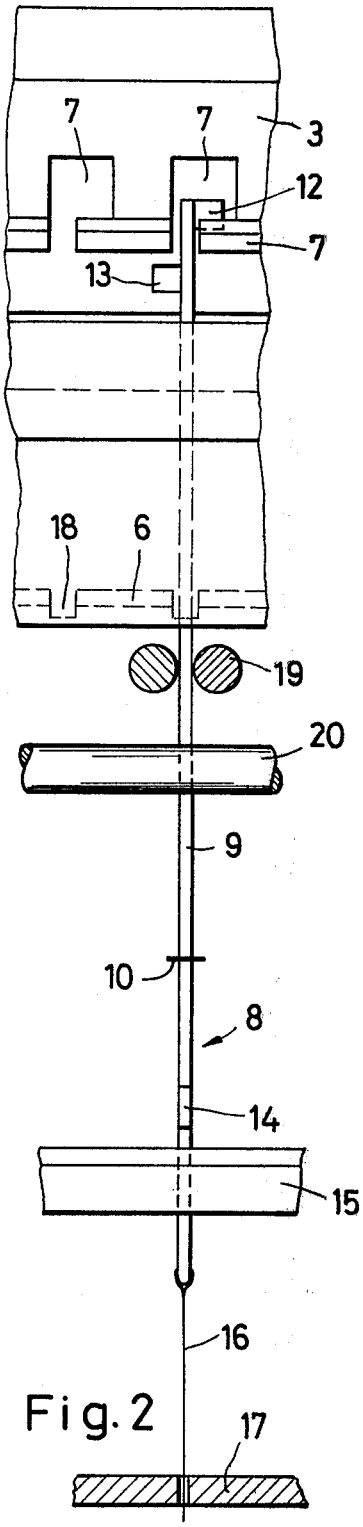

In a first embodiment in accordance with FIGS. 1 and 2 there is shown a knife 1 which consists of a carrier part 2 and two hook plates 3 and 4 fastened to it at a distance from each other, said plates having control hooks 5 and 6 which are bent obliquely upward in opposite directions at their free lower ends. The hook plate 3 which is arranged in front as seen in the control direction is provided, between two control hooks 5, with an opening 7 for the passage of the upper end of a lifter 8.

The lifter 8 has a shank 9 of flat rectangular cross section whose larger width lies parallel to the main needle 10 and transverse to the longitudinal direction of the knife 1. At the upper end of the lifter 8 main hoses or projections 12 and 13 which protrude at a right angle are arranged at different heights, cooperating with the control hooks 5 and 6. Near its lower end a holding-up nose or projection 14 is fastened to the shank 9 of the lifter 8, said nose cooperating with a fixed upper-shed knife 15. A harness cord 16 is attached to the lower end of the lifter 8, said cord being conducted through a lifter bottom 17.

The upper end of the lifter 8 which bears the main nose 12 can pass, upon a corresponding control movement, through the opening 7 in the hook plate 3 so that it lies outside the path of movement of the control hook 5 between the two hook plates 3 and 4. Furthermore, the shank 9 of the lifter 8 can enter into notches 18 between the control hooks 6 on the hook plate 4.

In their central region the lifters 8 are guided between bars 19 of a grid, said bars being arranged parallel to the main needles 10. Furthermore, between the lifters 8 there are provided bars 20 of a grid which serve as stop for the vertical alignment of the lifters when the latter are not controlled by the main needles 10.

Figure 3:
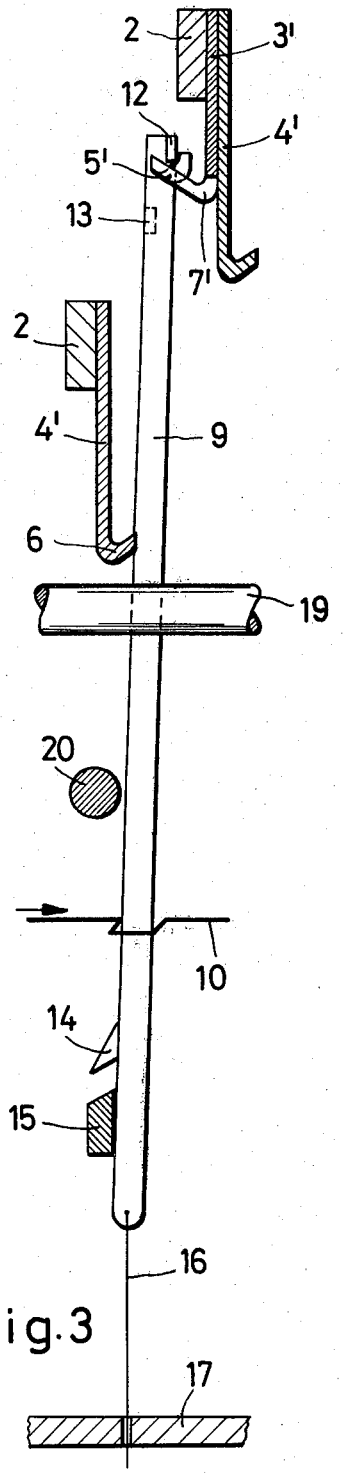
FIGS. 3 and 4 show a second embodiment in side view and in front view.
Figure 4:
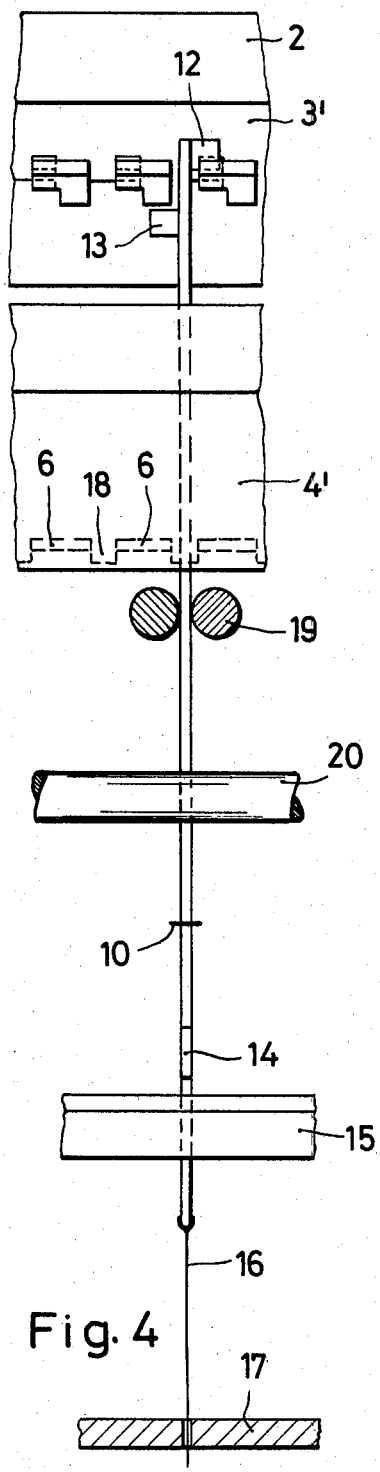
Figure 5:
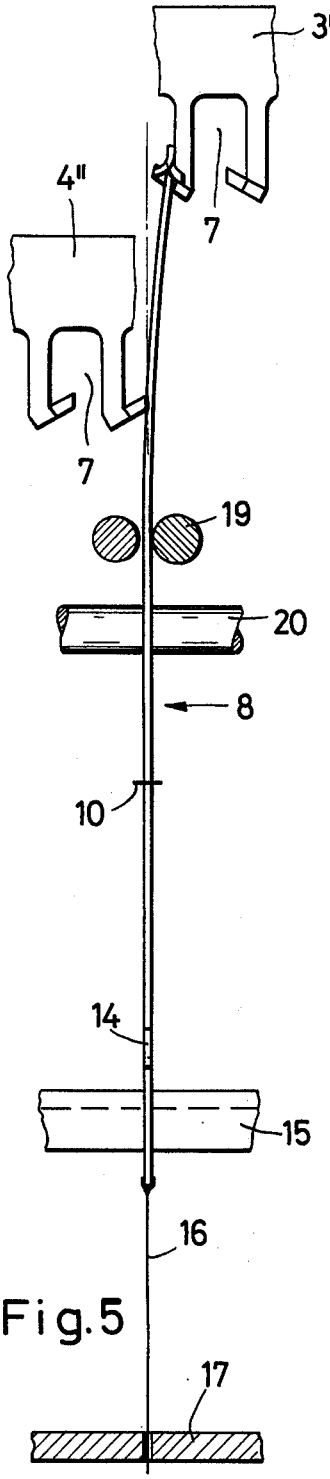
FIGS. 5 and 6 show a third embodiment in front view and in side view.
Figure 6:
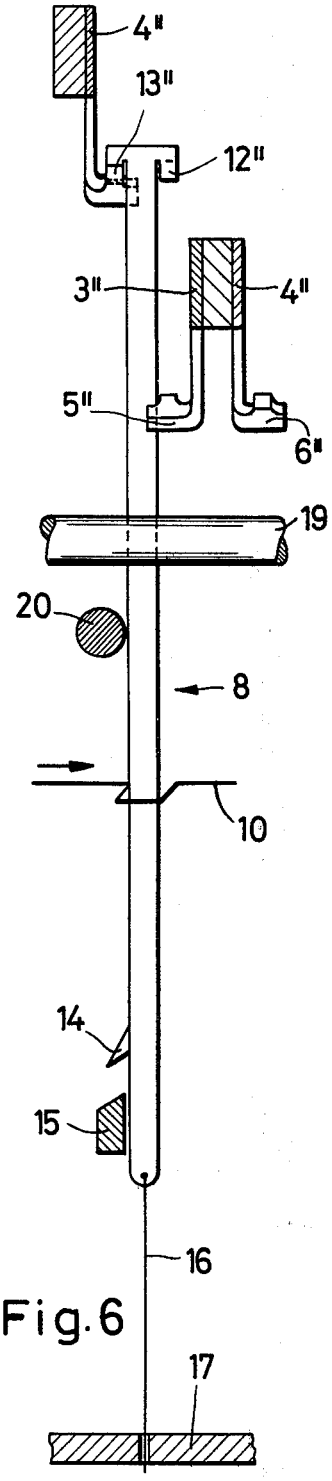
Figure 7:
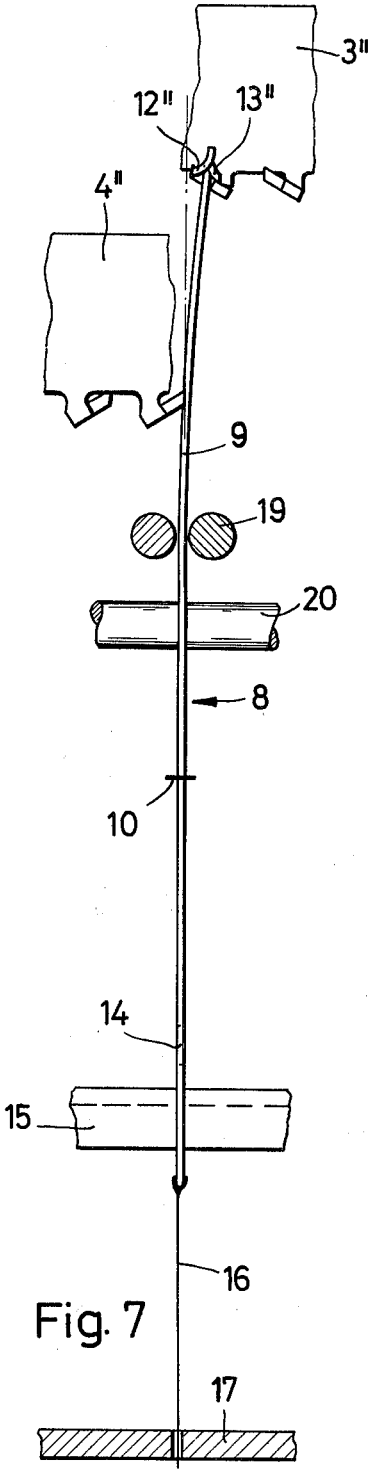
FIGS. 7 and 8 show a fourth embodiment in front view and in side view.
Figure 8:
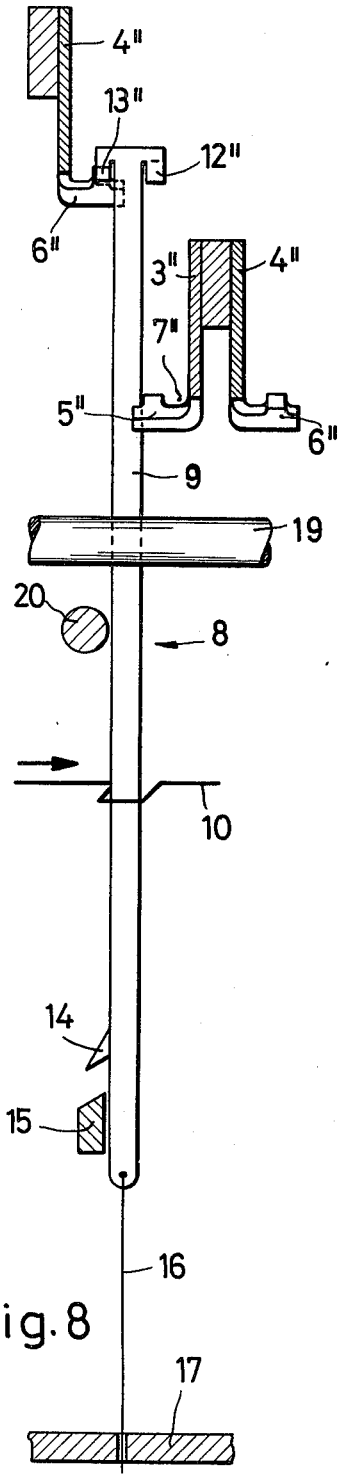

The embodiment shown in FIGS. 3 and 4 corresponds extensively to the embodiment described above, with the sole difference that the two hook plates 3' and 4' are in this case arranged on one side of the carrier part 2. In order to make passage of the upper end of the lifter 8 with the main nose 12 possible, the control hook 5' is bent upwards on its inside so that an opening 7' is produced.

In the embodiments shown in FIGS. 5 and 6 and 7 and 8 the hook plates 3'' and 4'' are provided with control hooks 5'' and 6'' which are bent off in longitudinal direction and furthermore transversely to the longitudinal direction of the main needles 10. These control hooks 5'' and 6'' cooperate with the lifters 8 which at the upper end of this shank 9 have a T-shaped head with main noses or projections 12'' and 13'' bent off transversely to the longitudinal direction of the main needles 10. In the embodiment shown in FIGS. 5 and 6, the head of the lifters 8 can be conducted into an opening 7 between two control hooks 5'' or 6'' while in the embodiment shown in FIGS. 7 and 8 the control hook 5'' is extended to such an extent that an opening 7'' remains between it and the hook plate 3'', the main nose 12'' being guided through said opening.

Figure 9:
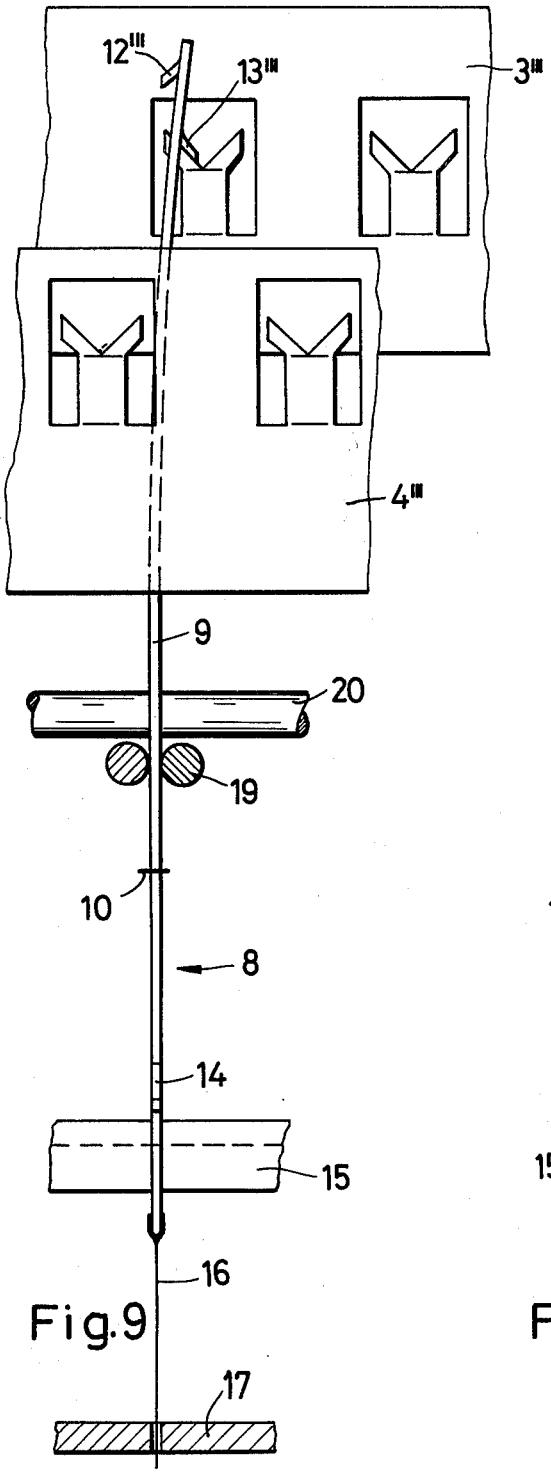
FIGS. 9 and 10 show a fifth embodiment in front view and in side view.
Figure 10:
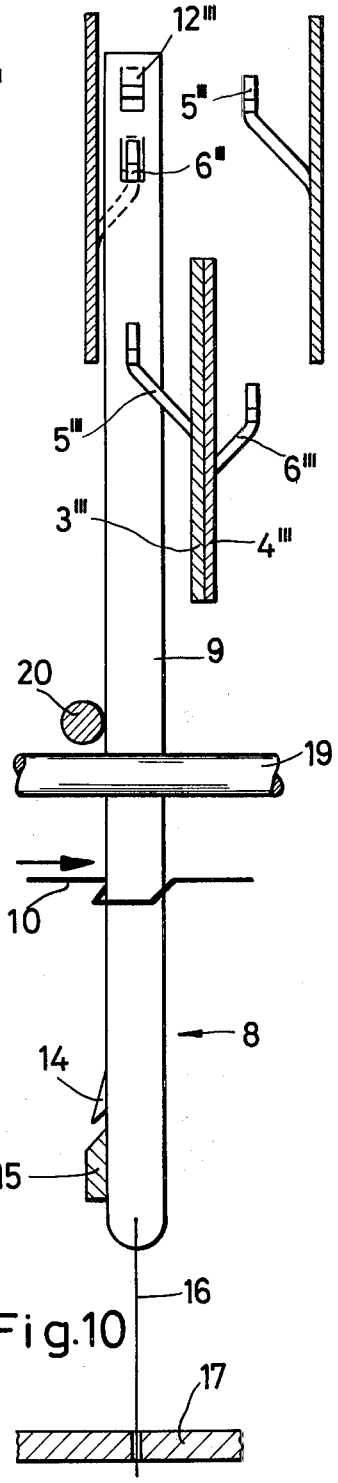

In the embodiment shown in FIGS. 9 and 10, control hooks 5''' and 6''' are punched out of the hook plates 3''' and 4''', bent laterally out of the plane of the plate, and notched in V-shape at the upper end so that control hooks which are bent off transversely to the longitudinal direction of the main needles 10 are produced. These control hooks cooperate with main noses or projections 12''' and 13''' which are also punched out of the shank 9 of the lifter 8 and bent out transversely to the longitudinal direction of the main needles 10. Since the distance of the control hooks 5''' from the hook plate 3''' is greater than one-half the width of the shank 9 of the lifter 8, the main nose 12''' can slide past the control hook 5''' on the inside when the corresponding lifter 8 is not to be moved out of its lower-shed position.

Figure 11:
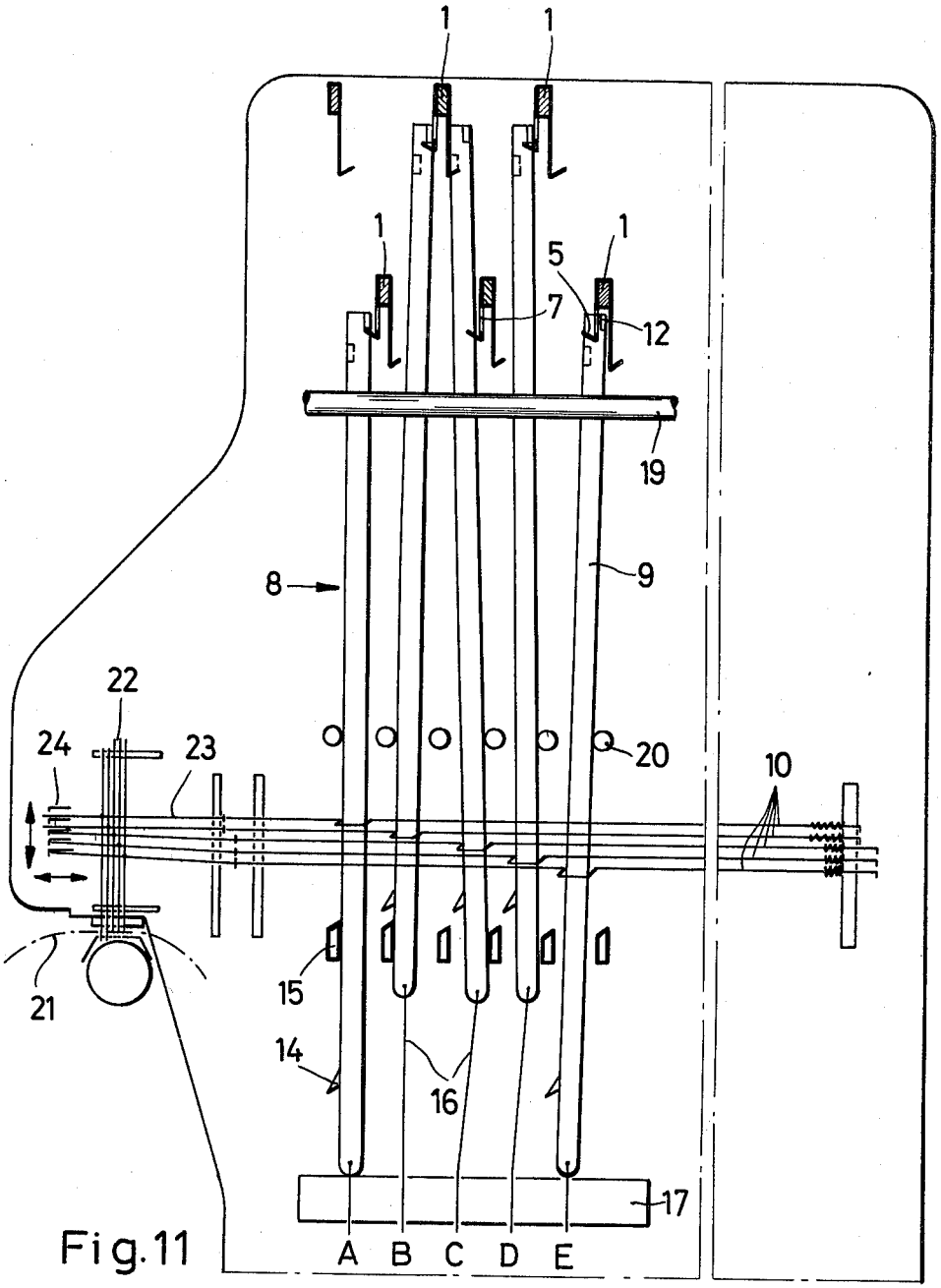
FIG. 11 shows diagrammatically the development of a double-lift open-shed Jacquard machine having five lifters in different control positions, seen in side view.

The function of a double-lift open-shed jacquard machine developed in accordance with the invention will be described below on basis of the schematic showing given in FIG. 11, with the use of the knife and lifter arrangement shown in FIGS. 1 and 2. Nevertheless the following functional description can also be applied, by analogy, to the embodiments of the knife and lifter arrangements shown also in FIGS. 3 to 10. In order to facilitate the description of the operation, the different positions of the lifters 8 have been provided consecutively with the letters A, B, C, D and E.

The lifters 8 are controlled in known manner by a pattern card 21 via a needle mechanism which consists of feeler needles 22, head needles 23 and the main needles 10, by means of a pressing grid 24 which is moved on a curve in the direction of the crossing double-ended arrows.

For position A of the lifter 8, the corresponding feeler needle 22 has found a hole in the pattern card 21 so that the head needle 23 is not pushed off by the pressing grid 24 and therefore remains in position of rest together with the corresponding main needle 10. The lifter 8 is thus not pushed off and it is therefore grasped by a lower knife 1 and pulled out of the lower shed position upwards into the upper shed position which corresponds to position B. Upon the lowering of the knife 1 from which the lifter 8 is suspended, it is placed with its holding-up nose 14 on the upper-shed knife 15. In this position it can remain in the upper shed.

In position C, the feeler needle 22 of the lifter 8 which is in the upper-shed position has not found any hole in the pattern card 21 so that the lifter 8 is pressed off by the pressing grid 24 via the pre-needle mechanism and the holding-up nose 14 is thus pressed out of the range of the upper-shed knife 15. The lifter 8 can thus be conducted into the lower-shed from position C with the knife 1.

In position D, the lifter 8 has been brought by the knife 1 into the upper-shed position. Since, however, the corresponding feeler needle 22 has not found any hole in the pattern card 21, the lifter 8 has been pressed off via the pre-needle mechanism by the pressing grid 24. In this way the holding-up nose 14 remains free from the upper-shed knife 15 so that the lifter 8 is again immediately lowered into the lower shed, which corresponds to position A.

In position E, the lifter 8 is in the lower-shed position and has been placed on the lifter bottom 17. The corresponding feeler needle 22 has not found any hole in the pattern card 21 so that the lifter 8 has been pressed off via the pre-needle mechanism by the pressing grid 24. In this way, the upper end of the shank 9 of the lifter is swung to such an extent that the main nose 12 passes through the opening 7 in the hook plate 4 and thus comes out of engagement with the control hook 5 when the knife 1 is moved out of the lower-shed position into the upper-shed position. A lifter 8 in position E therefore remains in the lower shed.

We claim:

1. In a double-lift open-shed Jacquard machine with two lifting bars which are movable in opposite directions to each other and which pass each other, and with lifters controllable by main needles, the latter being arranged transverse to the knives of the lifting bars, which lifters have two main projections associated with the movable knives and one holding-up projection associated with a fixed upper-shed knife, the improvement wherein the movable knives are made of a knife carrier part and hook plates fastened thereto, the hook plates having control hooks, the latter being formed bent off in the direction towards the main projections of the lifters and being arranged spaced apart from each other, said hook plates and said control hooks thereof being formed so to permit in a control direction of the main needles a passage of the lifters up into a plane between said control hooks of a movable knife, and the lifters have each a shank of a flat rectangular cross-section, the greater tilting moment of which is in the control direction of the main needle, at least one of said control hooks and the main projections are beveled such that an overlapping thereof increases during a driving of said lifters.

2. The Jacquard machine according to claim 1, wherein said control hooks and the main projections extend parallel to a longitudinal direction of the movable knives.

3. The Jacquard machine according to claim 1, wherein one of said hook plates is frontward in the control direction and is formed with openings between the control hooks for the passage of the lifters therethrough.

4. The Jacquard machine according to claim 1, wherein one of said hook plates is rearward in the control direction and is formed with notches disposed in a movement plane of the lifters.

5. The Jacquard machine according to claim 1, wherein said hook plates of each said movable knives constitute two said hook plates, said control hooks of said two hook plates of said movable knife and the main projections of the lifters are disposed at different heights.

6. The Jacquard machine according to claim 1, wherein said hook plates of each said movable knives constitute two said hook plates, said control hooks of said two hook plates of said movable knife and the main projections of the lifters are disposed at the same height.

7. The Jacquard machine according to claim 1, wherein the main projections project perpendicularly from the plane of the shank of the lifter at both sides thereof.

8. The Jacquard machine according to claim 1, wherein the lifters are formed with a T-shaped head and the main projections are bent-off therefrom on both sides of the shank toward different sides.

9. The Jacquard machine according to claim 1, wherein the main projections are punched and laterally bent-out at different heights from the shank of the lifters.

10. The Jacquard machine according to claim 1, wherein said control hooks are stamped out from said hook sheets, laterally bent-out and notched V-shaped.

11. The Jacquard machine according to claim 1, wherein said control hooks comprise individual elements, said individual elements are fastened to said knife carrier part and are coordinated to each of said lifters, respectively.

12. The Jacquard machine according to claim 1, wherein said hook plates of each said movable knife constitutes two hook plates.

* * * * *

UNITED STATES PATENT AND TRADEMARK OFFICE

CERTIFICATE OF CORRECTION

PATENT NO. : 4,291,730

DATED : September 29, 1981

INVENTOR(S) : Hubert Kremer et al

It is certified that error appears in the above-identified patent and that said Letters Patent are hereby corrected as shown below:

Item [73] Assignee: "Maschinenfabrik Carl Sangs" should read

--Maschinenfabrik Carl Zangs--

Signed and Sealed this

*Eighth* Day of *December 1981*

[SEAL]

*Attest:*

GERALD J. MOSSINGHOFF

*Attesting Officer*

*Commissioner of Patents and Trademarks*